US009547323B2

(12) United States Patent
Bhattad

(10) Patent No.: US 9,547,323 B2
(45) Date of Patent: Jan. 17, 2017

(54) CURRENT SINK STAGE FOR LDO

(71) Applicant: Dialog Semiconductor GmbH, Kirchheim/Teck-Nabern (DE)

(72) Inventor: Ambreesh Bhattad, Swindon (GB)

(73) Assignee: Dialog Semiconductor (UK) Limited, London (GB)

( * ) Notice: Subject to any disclaimer, the term of this patent is extended or adjusted under 35 U.S.C. 154(b) by 24 days.

(21) Appl. No.: 14/592,015

(22) Filed: Jan. 8, 2015

(65) Prior Publication Data

US 2015/0346750 A1 Dec. 3, 2015

Related U.S. Application Data

(60) Provisional application No. 62/006,570, filed on Jun. 2, 2014.

(30) Foreign Application Priority Data

Jan. 6, 2015 (EP) ..... 15150230

(51) Int. Cl.
*G05F 1/575* (2006.01)
*G05F 3/26* (2006.01)
*G05F 1/56* (2006.01)

(52) U.S. Cl.
CPC ..... *G05F 1/575* (2013.01); *G05F 1/56* (2013.01); *G05F 3/267* (2013.01)

(58) Field of Classification Search
CPC ..... G05F 1/575
USPC ..... 323/280
See application file for complete search history.

(56) References Cited

U.S. PATENT DOCUMENTS

| | | | | |
|---|---|---|---|---|
| 5,637,992 | A * | 6/1997 | Edwards | G05F 3/16 323/315 |
| 6,333,623 | B1 | 12/2001 | Heisley et al. | |
| 6,949,972 | B1 | 9/2005 | Knight | |
| 6,977,491 | B1 | 12/2005 | Caldwell et al. | |
| 7,602,162 | B2 | 10/2009 | Bansal et al. | |
| 2008/0094045 | A1 * | 4/2008 | Lin | G05F 1/56 323/274 |
| 2008/0129377 | A1 | 6/2008 | You et al. | |
| 2008/0224679 | A1 | 9/2008 | Sahni et al. | |
| 2009/0322292 | A1 | 12/2009 | Augustyniak | |
| 2013/0113446 | A1 | 5/2013 | De Haas | |

FOREIGN PATENT DOCUMENTS

EP 2 648 061 10/2013

OTHER PUBLICATIONS

European Search Report 15150230.9-1807, Oct. 1, 2015, Dialog Semiconductor GmbH.

(Continued)

*Primary Examiner* — Jeffrey Gblende
*Assistant Examiner* — Trinh Dang
(74) *Attorney, Agent, or Firm* — Saile Ackerman LLC; Stephen B. Ackerman

(57) ABSTRACT

An LDO circuit with a current sink stage reduces significantly overshooting of the output voltage due to sudden changes of output current. The activation of the current sink stage is independent of the overshoot percentage of the regulated output voltage. The disclosure doesn't require large output capacitors to avoid the possibility of brownouts of chips supplied by the LDO.

16 Claims, 9 Drawing Sheets

(56) References Cited

OTHER PUBLICATIONS

"A Current-Efficient, Low-Dropout Regulator with Improved Load Regulation," by Luis Gutierrez et al., Microelectronics and Electron Devices, 2009, WMED 2009, IEEE Workshop on IEEE Apr. 3, 2009, pp. 1-4.

* cited by examiner

CURRENT SINK STAGE FOR LDO

BACKGROUND

Technical Field

The present document relates to DC-to-DC converters. In particular, the present document relates to a current sink stage for low drop-out (LDO) regulators.

Background

LDOs are traditionally unidirectional power supplies i.e. they can either sink or source current.

In case of an LDO sourcing current there is either no sink capability or very small current sink capability, which would be triggered only if the voltage at output overshoots a certain percentage more than the expected regulated voltage. The voltage at the output of LDO can overshoot in an event of sudden removal of load.

If the voltage at output overshoots but is within the specified tolerance the current sink would usually not be enabled. This results in skewing of the potential at internal nodes of the LDO and slower response to a load transient (sudden requirement of current by the load), a slower response translating to a larger dip in the regulated output voltage, which may generate a brown-out condition for the chip being powered by LDO, this is especially true for ICs requiring low voltages A common way to reduce the dip in the output voltage is to increase the output decoupling capacitor which means a larger footprint on the very expensive PCB real estate especially in the case of handheld devices.

Current sinks are also needed to avoid back powering of the battery if current is pushed into the output of LDO by some source external to a PMIC.

Using bi-directional push-pull LDOs may be a solution but they are very complex to compensate and require additional quiescent current. The additional current eats into a very tight power budget for a PMIC in low power mode.

A current sink is implemented using either a comparator or an amplifier. Both have advantages and disadvantages. An amplifier would regulate the voltage at the output by regulating the current it sinks depending on the current sourced into the output of LDO, but are difficult to compensate. Comparators on the other hand don't require any compensation but may suffer from chattering and they don't regulate the output voltage if current pushed into the LDO output is less than the current sink capability of the comparator.

FIG. 1 prior art shows a simplified schematic of an implementation of an LDO with a current sink or over-voltage sink.

P1 is the pass device and A1 is an amplifier controlling the gate of P1. R2, R1 & Rprot form a feedback resistor divider network for regulating the output voltage. C1 is an external decoupling capacitor. The load is an external IC powered by the LDO A2 and transistor N1 form an over-voltage sink. A2 can be configured as a comparator or as an amplifier. Under normal operation Vov is lower than the reference voltage Vref and the gate of N1 is pulled to ground, so no current is sunk from the output. In an overvoltage condition, if the voltage at Vov is higher than or equal to Vref, the current sink is activated. The gate of N1 is driven by A2 to sink the current from output voltage VOUT.

If A2 is configured as a comparator, the gate of N1 is driven either to supply or ground. If A2 along with N1 and capacitor C1 is configured as an amplifier, the gate of N1 is regulated depending on the difference between Vov and Vref FIG. 2 prior art shows a plot of a response of the LDO of FIG. 1, wherein A2 is configured as a comparator and a current of 1 mA is sourced into the output of the LDO. As the current sourced is lower than the sink capability of comparator we observe a 20 mV of saw tooth at the output of LDO. The gate of N1 swings between ground and supply voltage. If such an LDO has to power a sensitive analog chip, such a saw tooth response at the output is undesirable. The output voltage, when the sourced current is removed, raises nearly 35 mV above the regulated target voltage and all the internal nodes of LDO are completely skewed at this point.

FIG. 3 prior art shows a plot of a response of the LDO of FIG. 1, wherein A2 is configured as an amplifier and a current of 1 mA is sourced into the output of the LDO. As FIG. 3 shows, the output voltage of the LDO is regulated and the gate of N1 is regulated to sink 1 mA of current. The output voltage, when the sourced current is removed, is nearly 10 mV higher than the regulated target voltage and all the internal nodes of LDO are completely skewed at this point.

It is a challenge for designers of LDOs to achieve LDOs, wherein activation of current sink is independent of the percentage overshoot above the regulated output voltage, that regulate the output voltage to a defined output voltage if the current sourced into LDO is less than the current sink capability, wherein a dip in the output voltage is within a minimal load transient specification, any possibility of brown-out condition is avoided, and which don't require larger capacitors at the output to avoid a possibility of brown-out condition.

Solutions are desired to avoid the drawbacks mentioned above.

SUMMARY

A principal object of the present disclosure is to achieve an LDO, wherein activation of current sink is independent of an overshoot in the regulated output voltage.

A further object of the disclosure is to achieve an LDO, wherein a current sink stage sinks a regulated amount of current. The current is regulated as it is controlled by a feedback loop. The current sunk by the circuit will be equal to the current sourced into the LDO, limited by maximum current sink capability.

A further object of the disclosure is to achieve an LDO that doesn't require any compensation for this current sink circuit.

A further object of the disclosure is to achieve an LDO regulating the output voltage to a defined output voltage if the current sourced into LDO is less than the maximum current sink capability of the current sink.

A further object of the disclosure is to achieve an LDO, wherein the dip in the output voltage is within a load transient specification for a series of randomly occurring load pulses that can skew the internal nodes of the LDO and any possibility of brown-out condition is avoided.

In accordance to the objects of the disclosure a Low Drop-Out voltage regulator (LDO) with a current sink circuitry, wherein the activation of the current sink is independent of a percentage of an overshoot of the regulated output voltage has been achieved. The LDO with current sink stage disclosed firstly comprises: an LDO comprising: a port for a VDD supply voltage, a port for output of the LDO, and a pass device, wherein a source of the pass device is connected to VDD supply voltage and a gate of the pass transistor is configured to be biased a threshold voltage below the VDD supply voltage of the pass device. Furthermore the LDO comprises an output voltage divider capable of providing a feedback voltage, which is proportional to the output voltage, and a differential amplifier, configured to comparing the feedback voltage with a reference voltage and to regulating a gate of the pass device depending on a difference between the feedback voltage and the reference voltage. Moreover the LDO comprises a current sink circuitry comprising a sensing circuit configured to detecting an overshoot of the output voltage of the LDO and a circuit configured to sinking current from the output of the LDO in case of detection of said overshoot of the output voltage, wherein an activation of the circuit configured to sinking current is independent of a percentage of overshoot above a target value of the output voltage and current from the output of the LDO is sunk as long as an overshoot of the output voltage of the LDO exists.

In accordance to the objects of the disclosure a method to achieve an LDO with a current sink stage, wherein activation of the current sink is independent of a percentage of an output voltage overshoot has been disclosed. The method disclosed comprises the steps of: (1) an LDO comprising a pass device, an output node, a circuitry capable of sensing proportionally an output voltage, a circuitry capable of detecting an overshoot of the output voltage of the LDO, and a current sink stage, (2) sensing the output voltage of the LDO, generating a feedback voltage, which is proportional to the output voltage, comparing the feedback voltage to a reference voltage, and regulating a gate of the pass device in order to keep the output voltage on a target value, (3) sensing the output voltage of the LDO in order to detect an output voltage overshoot, wherein a result of the sensing to detect an output voltage overshoot is not proportional to the output voltage and is independent of the sensing of the output voltage in order to generate the feedback voltage, and (4) activating the current sink stage in case an output voltage overshoot has been detected in order to sinking current from the output node until the output voltage overshoot condition is remediated, wherein the activation of the current sink stage is independent of the percentage of the output voltage overshoot.

SHORT DESCRIPTION OF THE FIGURES

The invention is explained below in an exemplary manner with reference to the accompanying drawings, wherein FIG. 1 prior art shows a simplified schematic of an implementation an LDO with a current sink or over-voltage sink.

FIG. 2 prior art shows a plot of a response of the LDO of FIG. 1, wherein A2 is configured as a comparator and wherein 1 mA of current is sourced into the output of the LDO.

FIG. 3 prior art shows a plot of a response of the LDO of FIG. 1, wherein A2 is configured as an amplifier and wherein 1 mA of current is sourced into the output of the LDO.

FIG. 4 depicts a circuit of an LDO with a current sink stage according to the present disclosure.

FIG. 5 exhibits the response of the LDO with the current sink circuit disclosed, shown in FIG. 4, for 1 mA of current sourced into output of LDO (load current).

DETAILED DESCRIPTION

The present disclosure relates to an LDO, wherein a dip in the output voltage of the LDO due to a random train of load transient is kept within a minimal load transient specification and any possibility of brown-out condition is avoided. An overshoot of the output voltage occurs if the output voltage exceeds a range of the output voltage defined by a circuit specification.

Figure 4:
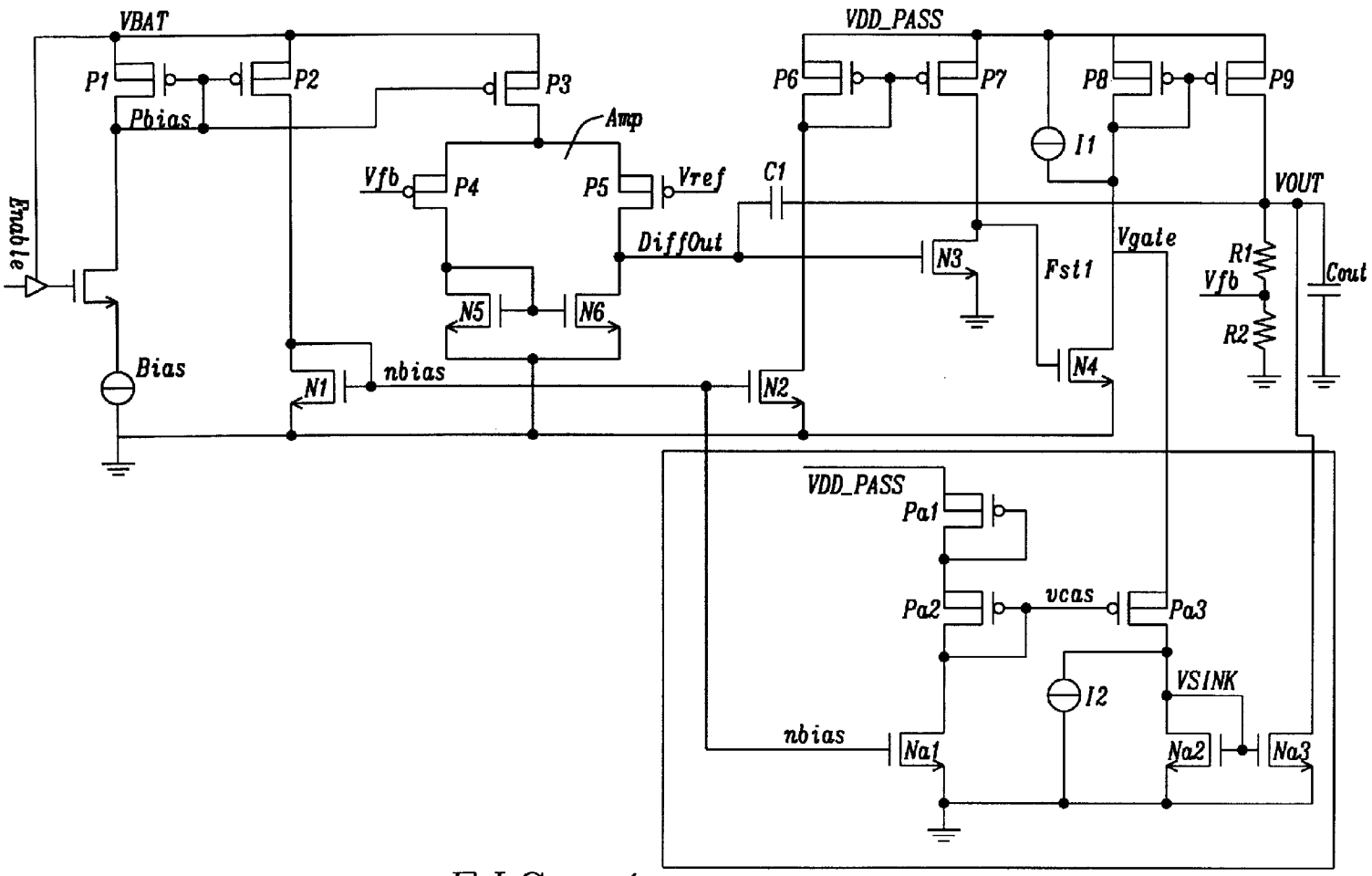

FIG. 4 depicts a circuit of an LDO with a current sink stage 40 according to the present disclosure. The circuit disclosed comprises a sensing circuit to detect an overvoltage condition and a circuit to sink the current from output.

Current source I1 and transistors Pa1, Pa2, Pa3, and Na1 are part of a sensing circuit to detect an overvoltage condition of the output voltage. Current sources I1 and I2 and transistors Pa3, Na2 and Na3 are a part of current sink circuit.

It should be noted that sensing of an overshoot condition is performed from a different point than sensing the output voltage via resistive voltage divider R1 and R2 using feedback voltage Vfb, which is compared with the reference voltage Vref to generate the voltage Diffout.

Figure 1:
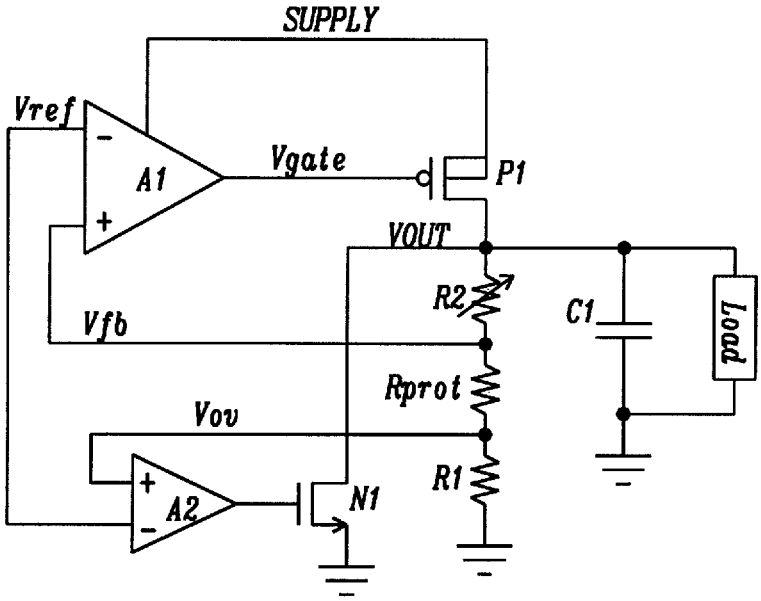
FIG. 1 Prior Art
Figure 2:
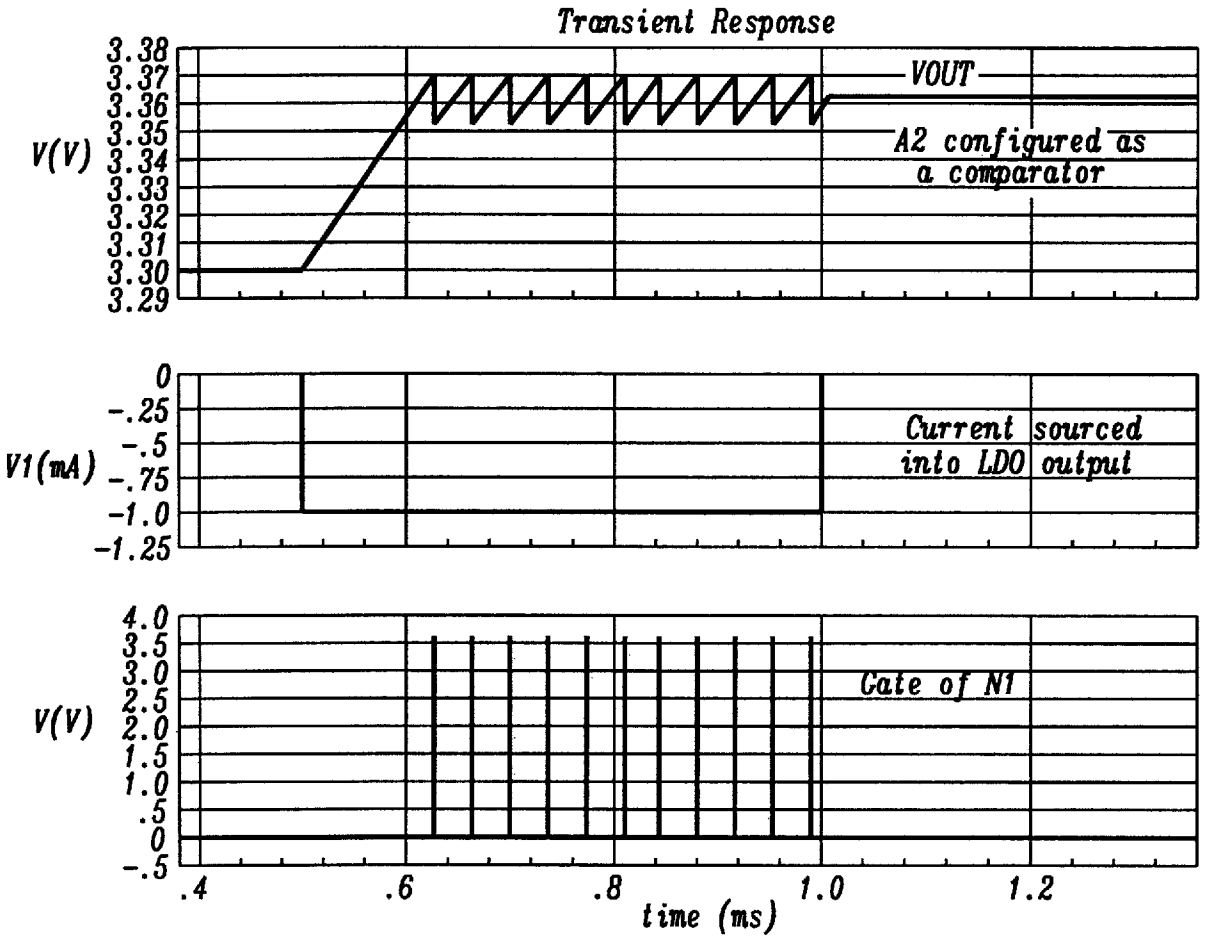
FIG. 2 Prior Art
Figure 3:
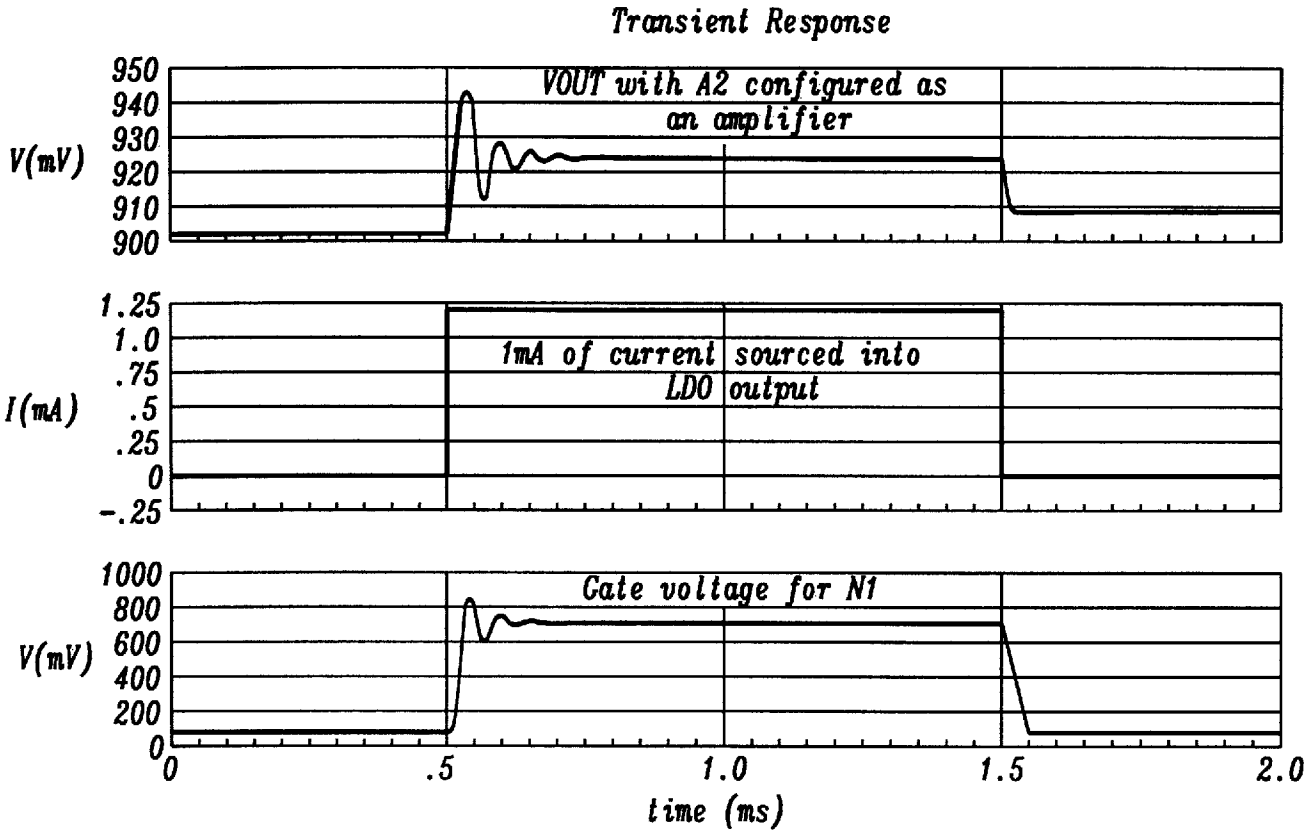
FIG. 3 Prior Art

It should be noted that the sensing of the overshoot condition of the output voltage is not proportional to the output voltage, since this circuit does not use a resistor divider tap as shown in FIG. 1 to sense an overvoltage condition.

Transistors Pa1, Pa2 and Na1, being a part of the overshoot voltage sensing circuit, generate the potential "vcas" to bias the gate of transistor Pa3. Transistors Pa1 and Pa2 are sized such that transistor Pa3 would conduct only when Vgate voltage is less than VDD_PASS minus threshold voltage $Vth_{P8}$. Transistors Pa1, Pa2, P8 and P9 are of the same type, and are matched.

I1 is a current source used to bias transistor N4 under no load condition due to a very large ratio between transistors P3 and pass device P9. Under normal operating condition transistor Pa3 is OFF as the voltage difference Vgate−vcas is less than threshold voltage for Pa3.

Current source I2 makes sure than in normal operating condition, if there is any leakage from Pa3 to VSINK, the potential at gate of Na3 is pulled to ground.

In an event of overvoltage of feedback voltage Vfb being higher than reference voltage Vref causing potential at Diffout to increase, node Fst1 is pulled low to turn off transistor N4. Current source I1 tries to pull the voltage Vgate to VDD_PASS.

As the potential difference between Vgate and vcas gets higher than threshold voltage of Pa3, the current I1 starts to flow from transistor Pa3 to transistor Na2. Transistors Na2 and Na3 form a current mirror. Transistor Na3 starts to sink current from VOUT. Transistor P7 is a current source load for N3. Capacitor C1 is a Miller capacitor to increase stability of the LDO. As shown in FIG. 4 Vout is connected to the drain of Na3. The gates of N1 and N2 are connected to the gate of device Na1.

The current from current source I1 and a ratio between transistors Na3 and Na2 define the maximum current that can be sunk from VOUT. Once the potential at VOUT starts to decrease, the internal nodes of the LDO start to return to their normal operating condition and eventually Pa3 is switched off. As Na3 sinks current from the output node VOUT, the external capacitor Cout at the LDO output "VOUT" is discharged. The output voltage VOUT is gradually reduced to correct the regulating voltage. As voltage VOUT reduces, so does feedback voltage Vfb and the current in the two branches to the differential amplifier Amp is balanced. This results in restoring the correct voltage at Diffout. As the voltage at Diffout is restored, the voltage at node Fst1 raises and voltage Vgate is restored to a threshold voltage below VDD_PASS. As this results in the gate-source voltage across transistor Pa3 to be less than the PMOS threshold voltage and transistor pa3 is turned off.

Current source I2 is much smaller compared to current source I1. Current source I2 could alternatively be replaced by a large resistor or a MOS transistor operating as a resistor.

It has to be noted that the activation of the current sink is independent of the percentage of overshoot of the regulated output voltage. The amount of, current sunk is regulated The circuit of FIG. 4 regulates the output voltage to programmed output voltage if the current sourced into the LDO is less than the current sink capability. Per normal LDO operation, transistor P9 supplies current in case the output voltage is lower than a target voltage. The current sink loop is stabilized by an external capacitor Cout at VOUT.

Devices P1, P2 and P3 form a current mirror. Similarly N1, N2 and Na1 also form a current mirror. The current generated by current source Bias is the current that when it flows into diode connected transistor P1 is mirrored into transistors P2 and P3 depending on the mirror ration between P1, P2, and P3.

Device Na1 is always conducting. Na1 acts as a current source to help generate the voltage Vcas, to determine when device Pa3 conducts. Pa3 turns on when Vgate>Vcas plus a threshold voltage.

The current mirrored from P1 to P2 flows into diode connected transistor N1 and sets the voltage "nbias".

Figure 5:
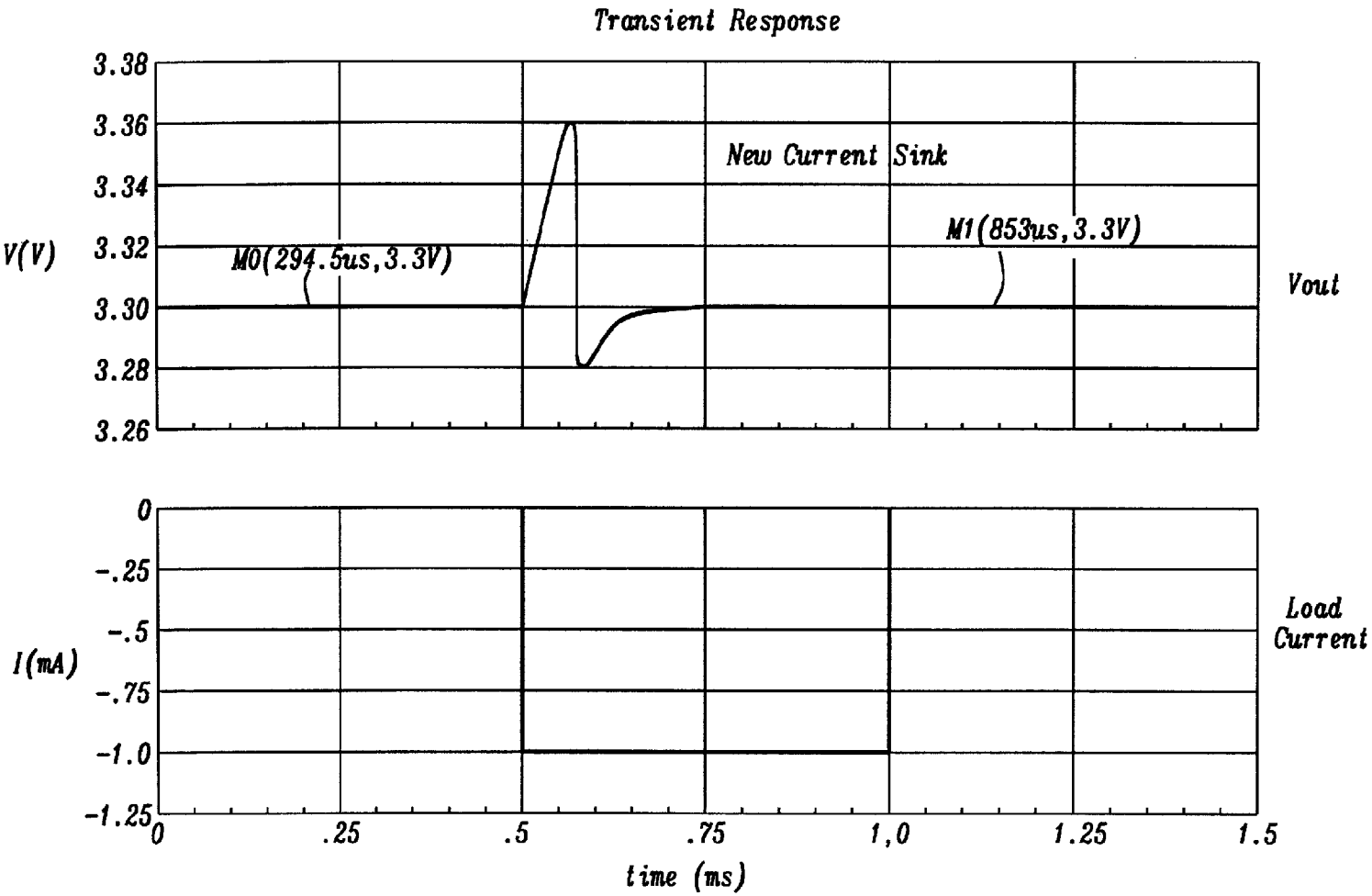

FIG. 5 exhibits the response of the LDO with the current sink circuit disclosed, shown in FIG. 4, for 1 mA of current sourced into output of LDO. As it can be observed the current sink disclosed regulates the voltage of the LDO at the required voltage of 3.3 V with a very small and short voltage jump of 60 mV with a duration of about 0.08 milliseconds, when 1 ma of current is pushed into the LDO.

Figure 6:
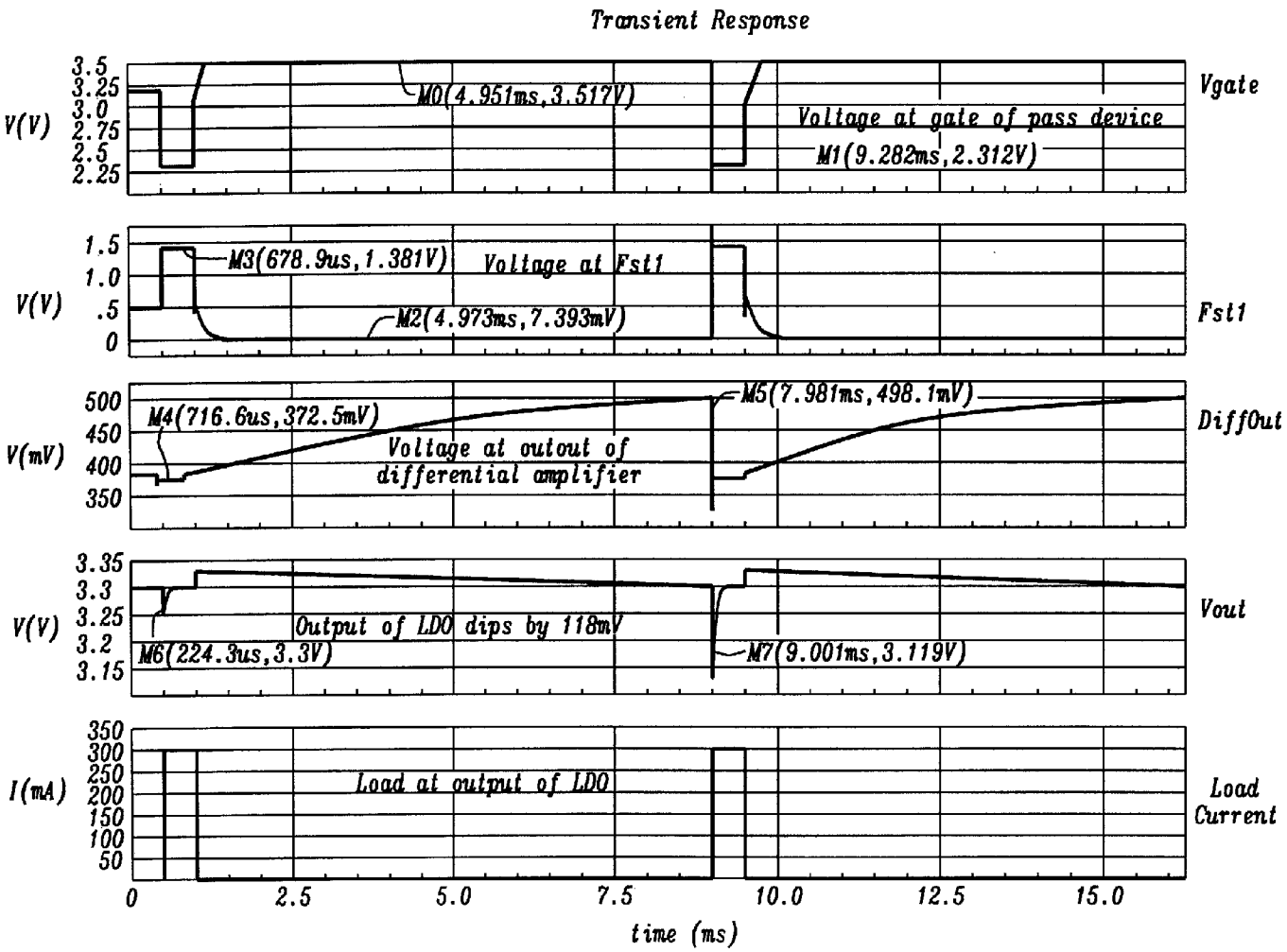
FIG. 6 shows the response of a 300 mA LDO using the prior art current sink implementation shown in FIG. 1 to a load transient from 0 mA to 300 mA in 1 us.

FIG. 6 shows the response of a 300 mA LDO using the prior art current sink implementation shown in FIG. 1 to a load transient from 0 mA to 300 mA in 1 us.

FIG. 6 shows from top down the Vgate voltage, the voltage at FST1, DiffOut voltage, the output voltage VOUT, and the load current. As it can be seen a release of load results in complete skewing of the internal nodes of the LDO, the gate of pass device is pulled to supply, the potential at node Fst1 is pulled to ground. An output voltage dip of 118 mV is caused by a load transient of 300 mA independent of the amplifier or comparator configuration of A2 in FIG. 1. A1 of FIG. 1 is the LDO circuit of FIG. 4, minus the sub-circuit containing devices PA1, PA2, PA3, NA1, NA2, NA3 and I2.

Figure 7:
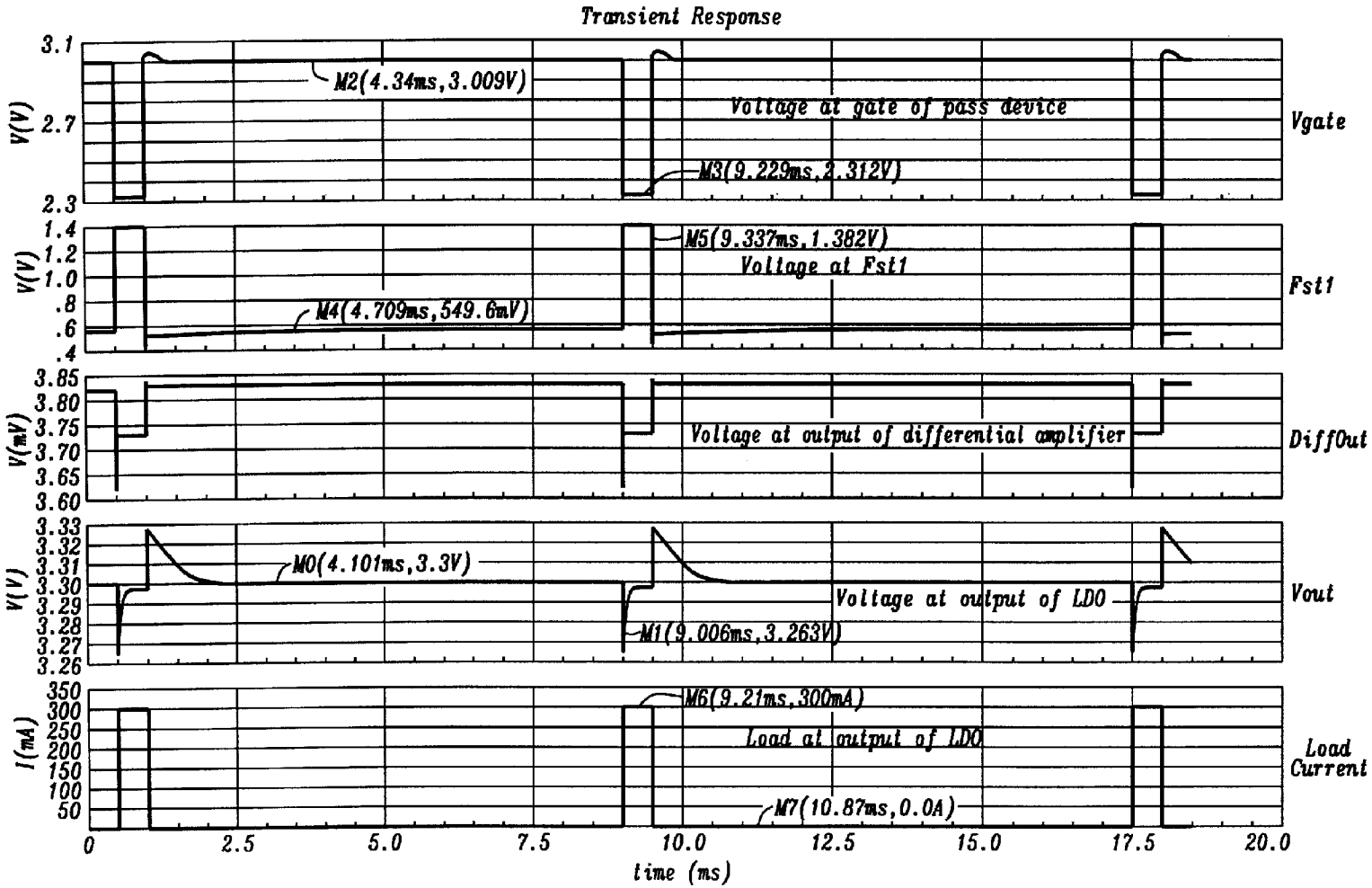
FIG. 7 shows the response of 300 mA LDO using the current sink implementation disclosed to a load transient from 0 mA to 300 mA in 1 us.

FIG. 7 shows the response of 300 mA LDO, using the current sink of the implementation disclosed, to a load transient from 0 mA to 300 mA in 1 us.

FIG. 7 shows from top down the Vgate voltage, the voltage at FST1, DiffOut voltage, the output voltage Vout, and the load current. As it can be seen a release of the load current does not result in skewing of the internal nodes of the LDO, the gate Vgate of pass device is biased a threshold voltage below the supply, the potential at node Fst1 is same as its normal operating point of 550 mV. The resulting load transient dip is 37 mV only.

Figure 8:
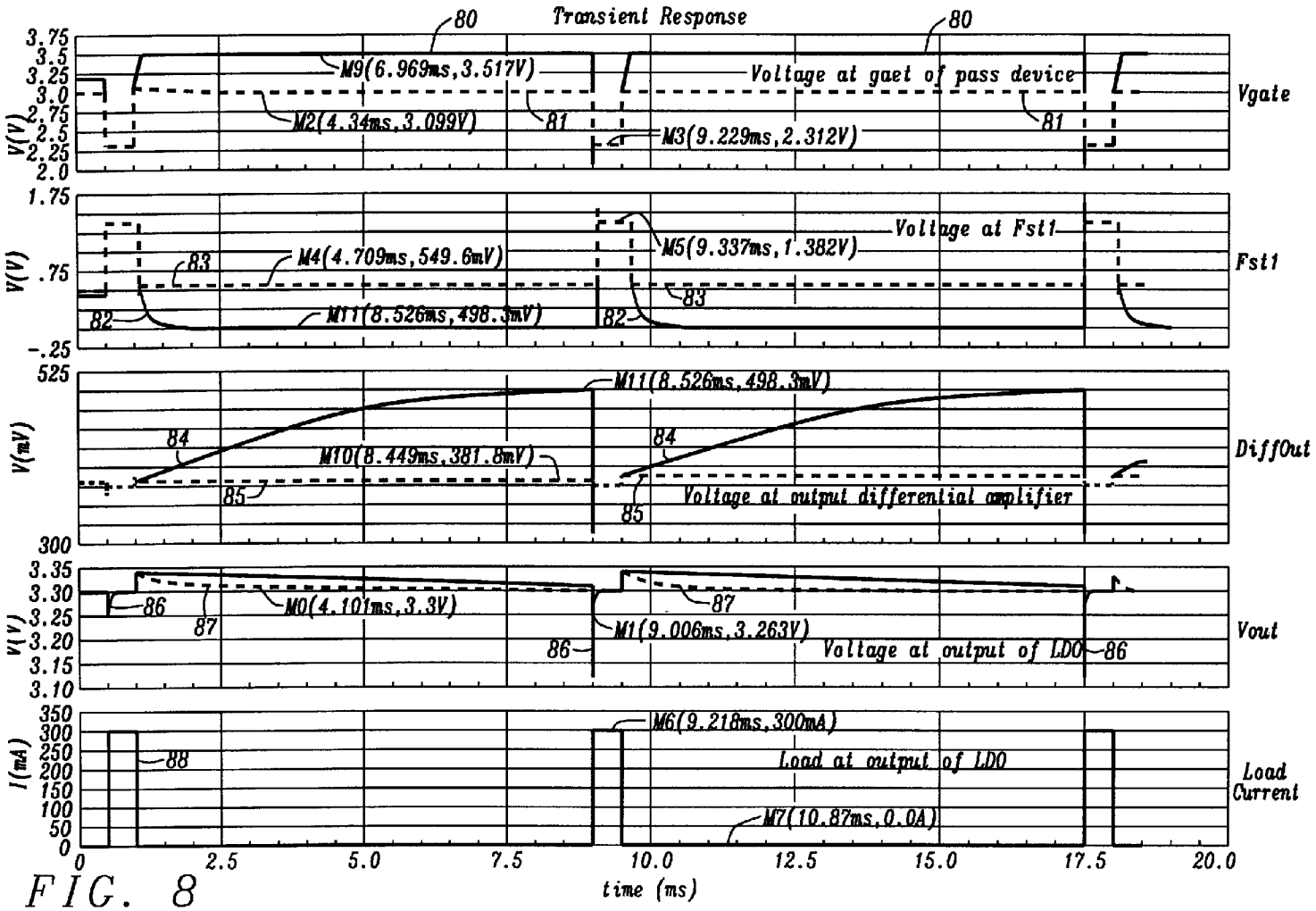
FIG. 8 shows a comparison between the circuit of FIG. 1 prior art and the circuit disclosed of FIG. 4 using a novel current sink for full scale load transient.

FIG. 8 shows a comparison between the circuit of FIG. 1 prior art and the circuit of FIG. 4 disclosed using a novel current sink for full scale load transient.

FIG. 8 compares the output of the LDOs shown in FIG. 1 prior art and in FIG. 4 along with the potential at internal nodes between two events of full scale load transient. Trace 88 shows the load current of the full scale load event.

Traces 80 and 81 show the voltage Vgate, trace 80 shows the trace of the prior art current sink, trace 81 shows the trace of the current sink disclosed. Traces 82 and 83 show the voltage FST1, trace 82 shows the trace of the prior art current sink, trace 83 shows the trace of the current sink disclosed. Traces 84 and 85 show the voltage Diffout, trace 84 shows the trace of the prior art current sink, trace 85 shows the trace of the current sink disclosed. Traces 86 and 87 show the output voltage Vout, trace 86 shows the trace of the prior art current sink, trace 87 shows the trace of the current sink disclosed. As it obvious that the novel current sink circuit disclosed has far better response compared to the old circuit.

Referring also the FIG. 4, it should be noted that a main point of the current sink disclosed is that the output Diffout of the differential amplifier remains relatively constant in case of the randomly occurring full scale load transient. In an event of overvoltage of feedback voltage Vfb being higher than reference voltage Vref causing potential at Diffout to slightly increase and turning on transistor N3, node Fst1 is pulled low to turn off transistor N4. Current source I1 tries to pull the voltage Vgate to VDD_PASS. As the potential difference between Vgate and vcas gets higher than threshold voltage of Pa3, the current I1 starts to flow from transistor Pa3 to transistor Na2. Transistors Na2 and Na3 form a current mirror. Transistor Na3 starts to sink current from VOUT. Once the potential at VOUT starts to decrease, the internal nodes of the LDO start to return to their normal operating condition and eventually Pa3 is switched off. It should be understood that the regulation process of the output voltage using the current sink is performed during a fraction of a millisecond as shown in trace 85.

Trace 87 shows an important advantage of the present disclosure, namely the dip of the output voltage is much smaller than the dip of the prior art. This may be of special importance in case the LDO is supplying a chip and a voltage dip such as with prior art is beyond an acceptable voltage swing of the chip. Such a situation would cause a brown-out of the chip which is unacceptable.

Figure 9:
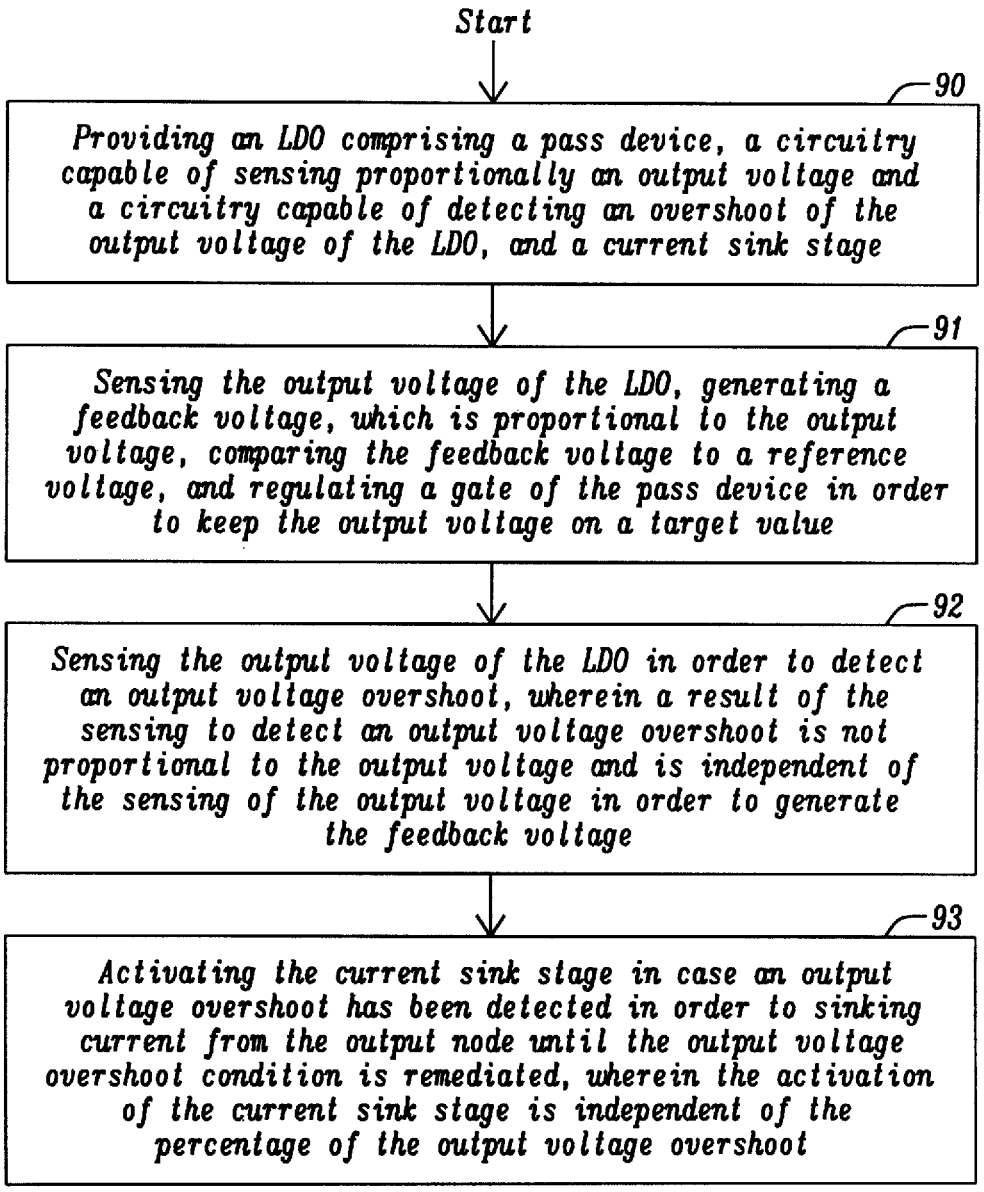
FIG. 9 illustrates a flowchart of a method to activate a current sink of an LDO independent of a percentage of overshoot of the output voltage of the LDO.

FIG. 9 illustrates a flowchart of a method to achieve an LDO with a current sink stage, wherein activation of the current sink is independent of a percentage of an output voltage overshoot. A first step 90 describes the provision of an LDO comprising a pass device, a circuitry capable of sensing proportionally an output voltage, a circuitry capable of detecting an overshoot of the output voltage of the LDO, and a current sink stage. Step 91 shows sensing the output voltage of the LDO, generating a feedback voltage, which is proportional to the output voltage, comparing the feedback voltage to a reference voltage, and regulating a gate of the pass device in order to keep the output voltage on a target value. Step 92 illustrates sensing the output voltage of the LDO in order to detect an output voltage overshoot, wherein a result of the sensing to detect an output voltage overshoot is not proportional to the output voltage and is independent of the sensing of the output voltage in order to generate the feedback voltage. The final step 93 depicts in case an output voltage overshoot has been detected in order to sinking current from the output node until the output voltage overshoot condition is remediated, wherein the activation of the current sink stage is independent of the percentage of the output voltage overshoot.

What is claimed is:

1. A Low drop-out voltage regulator (LDO) with a current sink circuitry wherein the activation of the current sink is independent of a percentage of an overshoot of the regulated output voltage comprising:

an LDO comprising:

a port for a VDD supply voltage;

a port for output of the LDO;

a pass device, wherein a source of the pass device is connected to VDD supply voltage and a gate of the pass transistor is configured to be biased a threshold voltage below the VDD supply voltage of the pass device;

an output voltage divider capable of providing a feedback voltage, which is proportional to the output voltage; and a differential amplifier, configured to comparing the feedback voltage with a reference voltage and to regulating a gate of the pass device depending on a difference between the feedback voltage and the reference voltage;

a current sink circuitry comprising:

a sensing circuit configured to detecting an overshoot of the output voltage of the LDO; and a circuit configured to sinking current from the output of the LDO in case of detection of said overshoot of the output voltage, wherein an activation of the circuit configured to sinking current is independent of a percentage of overshoot above a target value of the output voltage and current from the output of the LDO is sunk as long as an overshoot of the output voltage of the LDO exists;

wherein the current sink circuitry is capable of switching a current sensing transistor to current sinking mode when a voltage potential at its source is lower than the VDD supply voltage VDD minus a threshold voltage of a transistor connected in current mirror mode to the pass device and a voltage potential of a gate of a current sinking transistor is set to conduction mode by transistors of the sensing circuit configured to detecting an overshoot of the output voltage.

2. The LDO of claim 1, wherein an amount of current sunk is regulated.

3. The LDO of claim 1, wherein the sensing circuit comprises a first current source wherein a first terminal of the current source is connected to VDD supply voltage and a second terminal of the current source is connected to the gate of the pass device, to a gate and drain of a transistor connected in current mirror mode to the pass device, to a drain of a first NMOS transistor, and to a gate and source of a third current sensing transistor;

a first PMOS current sensing transistor having a source connected to VDD supply voltage and a gate and a drain connected to a source of a second PMOS current sensing transistor;

said second PMOS current sensing transistor having a gate connected to the gate of the third current sensing transistor and having the gate and a drain connected to the drain of a NMOS current sensing transistor;

said third PMOS current sensing transistor said third current sensing transistor, and its drain is connected to a drain and a gate of a transistor of the current sink circuit; and said first NMOS transistor having a source connected to ground, wherein its gate is biased via a bias current source.

4. A Low drop-out voltage regulator (LDO) with a current sink circuitry, wherein the activation of the current sink is independent of a percentage of an overshoot of the regulated output voltage comprising:

an LDO comprising:

a port for a VDD supply voltage;

a port for output of the LDO;

a pass device, wherein a source of the pass device is connected to VDD supply voltage and a gate of the pass transistor is configured to be biased a threshold voltage below the VDD supply voltage of the pass device;

an output voltage divider capable of providing a feedback voltage, which is proportional to the output voltage; and a differential amplifier, configured to comparing the feedback voltage with a reference voltage and an output of the differential amplifier is configured to be used to regulating the gate of the pass device depending on a difference between the feedback voltage and the reference voltage;

a current sink stage circuitry comprising:

a sensing circuit configured to detecting an overshoot of the output voltage of the LDO, wherein the sensing circuit is capable of detecting an overshoot condition of the output voltage of the LDO when a voltage potential at a source of a third transistor of the current sensing circuit is lower than the VDD supply voltage minus a threshold voltage of the pass device and consequently switching the third current sensing transistor to current sinking mode and thus a voltage potential of a gate of the first current sinking transistor is set to conduction mode thereby sinking current from the output of the LDO; and a circuit configured to sinking current from the output of the LDO in case of detection of said overshoot of the output voltage, wherein an activation of the circuit configured to sinking current is independent of a percentage of overshoot above a target value of the output voltage and current from the output of the LDO is sunk as long as an overshoot of the output voltage of the LDO exists.

5. The LDO of claim 4, wherein an amount of current sunk is regulated.

6. The LDO of claim 4, wherein said sensing circuit comprises:

a first current source, wherein a first terminal of the current source is connected to the VDD supply voltage and a second terminal of the current source is connected to the gate of the pass device and to a source of the third current sensing transistor;

said third current sensing transistor, wherein its gate is connected to a gate of a second current sensing transistor and to the drain of the second current sensing transistor and its drain is connected to a drain and a gate of a second transistor of the current sink circuit;

said second current sensing transistor, wherein its source is connected to a drain and to a gate of a first current sensing transistor and a drain is connected to a drain of a fourth current sensing transistor;

said first current sensing transistor wherein a source is connected to the VDD supply voltage; and said fourth current sensing transistor, wherein a source is connected to ground and a gate is connected to gates of a first transistor and a second transistor of the LDO.

7. The LDO of claim 4, wherein an eighth transistor is connected in a current mirror configuration to the pass device, wherein the eighth transistor is matched and of the same type as the pass device, and wherein a source of the eighth transistor is connected to the VDD supply voltage, a gate of the eighth transistor is connected to the gate of the pass device, to a drain of the eighth transistor, and to a source of a third transistor of the sensing circuit configured to detecting an overshoot of the output voltage of the LDO.

8. The LDO of claim 4, wherein the current sunk by the circuit is be equal to the current sourced into the LDO, limited by maximum current sink capability.

9. The LDO of claim 6, wherein said circuit configured to sinking current comprises:

said second transistor of the current sink circuit, wherein its source of the second transistor is connected to ground and its gate is connected to a gate of a first transistor of the current sink circuit;

said first transistor of the current sink circuit wherein its source is connected to ground and its drain is connected to the output port of the LDO; and a means to ensure that, if no voltage overshoot condition exists, if there is any leakage from said third current sensing transistor to the drain and gate of said second transistor of the current sink circuit, the potential of the gates of said first transistor and second transistor is pulled to ground.

10. The LDO of claim 9, wherein said means to ensure that, if no voltage overshoot condition exists, if there is any leakage from said third current sensing transistor to the drain and gate of said second transistor of the current sink circuit, the potential of the gates of said first transistor and second transistor is pulled to ground is a current source connected between the drain of the second transistor of the current sink circuit and ground.

11. The LDO of claim 9, wherein said means to ensure that, if no voltage overshoot condition exists, if there is any leakage from said third current sensing transistor to the drain and gate of said second transistor of the current sink circuit, the potential of the gates of said first transistor and second transistor is pulled to ground is a resistor connected between the drain of the second transistor of the current sink circuit and ground.

12. The LDO of claim 9, wherein said means to ensure that, if no voltage overshoot condition exists, if there is any leakage from said third current sensing transistor to the drain and gate of said second transistor of the current sink circuit, the potential of the gates of said first transistor and second transistor is pulled to ground is a transistor operating as resistor, connected between the drain of the second transistor of the current sink circuit and ground.

13. The LDO of claim 9, wherein a current from the first current source and a ratio between the first and the second transistor of the current sink circuit define the maximum current that can be sunk from the output of the LDO.

14. A method to achieve an LDO with a current sink stage, wherein activation of the current sink is independent of a percentage of an output voltage overshoot, comprising the steps of:

(1) an LDO comprising a pass device, an output node, a circuitry capable of sensing proportionally an output voltage and a circuitry capable of detecting an overshoot of the output voltage of the LDO, and a current sink stage;

(2) sensing the output voltage of the LDO, generating a feedback voltage, which is proportional to the output voltage, comparing the feedback voltage to a reference voltage, and regulating a gate of the pass device in order to keep the output voltage on a target value;

(3) sensing the output voltage of the LDO in order to detect an output voltage overshoot, wherein a result of the sensing to detect an output voltage overshoot is not proportional to the output voltage and is independent of the sensing of the output voltage in order to generate the feedback voltage, wherein an output voltage overshoot is detected when a voltage potential at a source of a transistor of the current sensing circuit is lower than the VDD supply voltage minus a threshold voltage of the pass device and consequently switching the third current sensing transistor to current sinking mode and thus a voltage potential of a gate of the first current sinking transistor is set to conduction mode thereby activating sinking current from the output of the LDO; and (4) activating the current sink stage in case an output voltage overshoot has been detected in order to sinking current from the output node until the output voltage overshoot condition is remediated, wherein the activation of the current sink stage is independent of the percentage of the output voltage overshoot.

15. The method of claim 14, wherein the amount of current sunk is regulated.

16. The method of claim 14, wherein the current sink regulation is stabilized by a capacitor connected between the output of the LDO and ground.

* * * * *